US006574823B1

(12) United States Patent
Stegens

(10) Patent No.: US 6,574,823 B1
(45) Date of Patent: Jun. 10, 2003

(54) BRUSHROLL

(75) Inventor: Alfred H. Stegens, Olmsted Township, OH (US)

(73) Assignee: The Scott Fetzer Company, Westlake, OH (US)

( * ) Notice: Subject to any disclaimer, the term of this patent is extended or adjusted under 35 U.S.C. 154(b) by 207 days.

(21) Appl. No.: 09/782,135

(22) Filed: Feb. 12, 2001

(51) Int. Cl.[7] ..... A46B 5/00

(52) U.S. Cl. ..... 15/182; 15/183; 15/179; 15/363; 15/366; 15/383

(58) Field of Search ..... 15/182, 183, 179, 15/363, 366, 383, 50.3, 52.1

(56) References Cited

U.S. PATENT DOCUMENTS

| | | | | | |
|---|---|---|---|---|---|
| 395,362 | A | * | 1/1889 | Spangenberg | 19/60 |
| 1,044,488 | A | | 11/1912 | Case | |
| 1,718,302 | A | | 6/1929 | Nulsen | |
| 1,922,752 | A | | 8/1933 | Vogler | |
| 1,942,497 | A | | 1/1934 | Smellie | |
| 2,271,545 | A | | 2/1942 | Cummings | |
| 2,271,554 | A | | 2/1942 | Smellie | |
| 2,271,555 | A | | 2/1942 | Gerber et al. | |
| 3,181,193 | A | | 5/1965 | Nobles et al. | |
| 3,457,575 | A | | 7/1969 | Bienek | |
| 3,828,387 | A | * | 8/1974 | Liebscher | 15/182 |
| 3,959,847 | A | | 6/1976 | Kaulig et al. | |
| 4,173,807 | A | | 11/1979 | Maier | |
| 4,307,479 | A | * | 12/1981 | Mertes et al. | 15/182 |
| 4,349,936 | A | | 9/1982 | Lorson et al. | |
| 4,357,727 | A | | 11/1982 | McDowell | |
| 4,372,004 | A | | 2/1983 | Vermillion | |
| 4,429,430 | A | | 2/1984 | Lyman | |
| 4,498,214 | A | | 2/1985 | Oxel | |
| 4,720,891 | A | | 1/1988 | Rennecker et al. | |
| 4,912,805 | A | | 4/1990 | Krasznai et al. | |
| 4,955,102 | A | | 9/1990 | Cousins | |
| 5,003,663 | A | | 4/1991 | Sunagawa et al. | |
| 5,272,785 | A | | 12/1993 | Stegens | |
| 5,452,490 | A | | 9/1995 | Brundula et al. | |
| 5,481,781 | A | | 1/1996 | Weber | |
| 5,495,634 | A | | 3/1996 | Brundula et al. | |
| D398,096 | S | | 9/1998 | Gildersleeve | |
| 6,021,545 | A | | 2/2000 | Delgado et al. | |
| 6,094,776 | A | | 8/2000 | Fish | |
| 6,125,495 | A | * | 10/2000 | Berg et al. | 15/183 |

* cited by examiner

*Primary Examiner*—Robert J. Warden, Sr.
*Assistant Examiner*—Shay Balsis
(74) *Attorney, Agent, or Firm*—Watts, Hoffmann, Fisher & Heinke, Co., L.P.A.

(57) ABSTRACT

A vacuum cleaner brushroll having angled tuft patterns effective to increase cleanability performance of the vacuum. The brushroll comprises a spindle and at least two patterns of bristled tufts. The patterns may be helical shaped rows. The rows may define tuft pairs, wherein each tuft in a pair is equidistant from a spindle each and shares a common sweeping path. A majority of the pairs are formed by tufts that are alternatively positioned at acute and obtuse angles to the spindle axis of the brushroll. Two tufts within a pair may be positioned at supplementary angles.

22 Claims, 6 Drawing Sheets

| TEST SAMPLE | VACUUM SOURCE | ASTM F608-89 CLEANABILITY PERCENTAGE | | PERCENTAGE IMPROVEMENT |
|---|---|---|---|---|
| | | OEM STOCK PERFORMANCE | MODIFICATION WITH ANGLED BRISTLES | |
| 1 | OEM A - MODEL 1 | 58.95 | 65.87 | 11.74% |
| 2 | OEM A - MODEL 2 | 49.40 | 53.97 | 9.25% |
| 3 | OEM B - MODEL 1 | 50.49 | 52.54 | 4.06% |
| 4 | OEM A - MODEL 3 | 44.95 | 51.29 | 14.10% |
| 5 | OEM A - MODEL 4 | 44.77 | 50.73 | 13.31% |
| 6 | OEM A - MODEL 5 | 47.67 | 55.66 | 16.76% |

*Fig. 6*

BRUSHROLL

FIELD OF THE INVENTION

The present invention relates generally to a brushroll for a vacuum cleaner sweeper, and more specifically, the invention is directed to a brushroll having angled tuft patterns which increase the performance of the brushroll.

BACKGROUND ART

Conventional vacuum cleaner sweepers typically include some type of brushroll for increasing cleanability. Prior art brushrolls generally comprise a wooden spindle that carries a plurality of tufts. A tuft consists of a plurality of thin predominantly nylon bristles. Most brushrolls contain one or more patterns of tufts that typically protrude from the spindle, perpendicular to the spindle longitudinal axis. The patterns conventionally form rows of tufts. The brushroll is typically turned by a pulley and belt system that is directly or indirectly attached to a vacuum cleaner motor. In the known operation of a vacuum sweeper, the user pushes the vacuum as the brushroll generally spins at a speeds in excess of 5,000 rpm. As the brushroll is rotated by the pulley, the tufts contact the carpet fibers to agitate the fibers, loosening dirt particles resting on or between the fibers. In practice, dirt particles loosened by the brushroll are then more effectively removed from the carpet by the suction forces of the vacuum.

It is known in the prior art to angle tufts near either end of the spindle "to reach out" to carpet areas near the edge of the vacuum sweeper housing. Tufts of this design can be found in the prior art, for example, in U.S. Pat. No. 6,003,198 to Stegens and U.S. Pat. No. 5,373,603 to Stegens. These designs feature a limited number of non-perpendicular tufts near either end of the spindle that angle toward the spindle end. In addition to increasing the effective coverage area of the sweeper, the angled tufts tend to prevent threads and other materials from embedding in the bearing end cap.

Other prior art spindle designs use angled tufts. U.S. Pat. No. 4,307,479 to Mertes et al. discloses a brushroll having an angled tuft pattern, with tufts perpendicular to the spindle longitudinal axis at or near the center of the spindle, and other tufts increasingly angled toward the nearest spindle end as a function of their distance from the spindle midpoint. Each row of tufts is angled similarly in these designs.

It is well accepted in the art that the cleanability of a vacuum sweeper may be measured by ASTM test procedure F608-89. Various parameters of a brushroll can be altered to increase the cleanability of the vacuum. Tuft material of increased strength, thickness, or length may be employed. The overall diameter of a tuft may also be increased. However, these methods can lead to decreased maneuverability for the vacuum and make the vacuum difficult to push. Also, due to the increased force required to rotate the brushroll to overcome increased frictional forces between the brushroll and the carpet, accelerated and premature belt wear may occur. Manufacturers may solve the problem of decreased maneuverability by producing self-propelled or partially-propelled models. Adding these or similar options increases the cost of the vacuum cleaner.

There remains a need in the art for an improved brushroll assembly that can significantly increase the cleanability of a vacuum sweeper, with little or no increased cost.

SUMMARY OF THE INVENTION

The present invention is directed to an improved brushroll for a vacuum cleaner sweeper. The brushroll features angled tuft patterns that increase the performance of the brushroll, without increasing cost or changing other brushroll or vacuum characteristics.

The effect of this angled pattern is to increase agitation of the carpet fibers. Tufts with a common sweeping path form a tuft set. One tuft of a tuft set applies forces on the carpet fiber in two directions, a direction parallel to the movement of the cleaner and a direction perpendicular. An opposing tuft in the same tuft set, applies forces in the parallel direction, and in an opposing perpendicular direction, 180° from the first perpendicular direction. The advantageous effect, that is documented through experimentation, is increased cleanability performance for the vacuum, compared to prior art brushroll designs.

According to one embodiment, a brushroll for use in a vacuum cleaner comprises a spindle and first and second rows of rotationally opposed bristles tufts. The first row has a majority of its tufts disposed at acute angles with respect to the spindle axis and tilted toward one end of the spindle. The second row has a majority of its tufts disposed at obtuse angles with respect to the spindle axis and tilted toward the other end of the spindle. "Acute" and "obtuse" as used herein refer to angles having one of their legs parallel to the spindle axis and extending toward a common end of the spindle.

The tilted tufts of the first row may be paired with tilted tufts of the second row with the tufts in each pair being equidistant from an end of the spindle, so that the tufts of each pair have a common sweeping path. The first and second rows may be diametrically opposed with respect to the spindle. A majority of tilted tufts of the first row may be at an obtuse angle of 97°, with at least some of the tilted tufts of the second row at supplemental angles of 83°.

According to another embodiment, a vacuum cleaner brushroll comprises a spindle and fist and second rows of bristle tufts extending along helical paths. The first row begins near one end of the spindle and continues toward the other end. The first row has a group of tufts perpendicular to the spindle axis, a second group of tufts tilted toward the other end at an angle of 3° from the perpendicular to the spindle axis, a third group of tufts tilted toward the other end at an angle of 5° from the perpendicular to the spindle axis, and a fourth group of tufts tilted toward the other end at an angle of 7° from the perpendicular to the spindle axis.

The second row begins near the other end and continues toward the one end. The second row has a first group of tufts perpendicular to the spindle axis, a second group of tufts tilted toward the one end at an angle of 3° from the perpendicular to the spindle axis, a third group of tufts tilted toward the one end at an angle of 5° from the perpendicular to the spindle axis, and a fourth group of tufts tilted toward the one end at an angle of 7° from the perpendicular to the spindle axis.

The fourth group of tufts of the first row is rotationally opposed to the first, second, third and part of fourth group tufts of the second row. The fourth group of tufts of the second row is rotationally opposed to first, second, third and part of the fourth groups of tufts of first row.

The first and second rows of tufts may be diametrically opposed.

According to another embodiment, a vacuum cleaner brushroll comprises a spindle and first and second rows of rotationally opposed bristle tufts. The first row has tufts arranged in tuft groups that are tilted toward one end of the spindle. Tufts in each group in the first row are tilted at the same angle with respect to the perpendicular to the axis of the spindle.

The second row has tufts arranged in tuft groups that are tilted toward the other end of the spindle. Tufts in each group in the second row are tilted at the same angle with respect to the perpendicular to the axis of the spindle.

Each row may include at least one group of tufts that are perpendicular to the axis of the spindle. The tuft groups in the first row may be tilted at increasingly larger angles progressing toward one end of the spindle. The tuft groups in the second row may be tilted at increasingly larger angles progressing toward the other end of the spindle. The first and second rows of tufts may be diametrically opposed with respect to the spindle.

According to yet another embodiment, a brushroll assembly for use in a vacuum cleaner comprises a generally cylindrical shaped spindle having a first end, a second end and a longitudinal axis. A plurality of tufts are arranged in at least two tuft patterns, wherein each of the tuft patterns extends along the longitudinal axis. The tuft patterns define a plurality of tuft sets.

Each tuft set includes one tuft from each of the at least two tuft patterns, wherein each tuft in the set is equidistant from the first end. At least one tuft set has at least one tuft disposed at an acute angle with respect to the longitudinal axis, and at least one tuft disposed at an obtuse angle with respect to the longitudinal axis.

A majority of the tuft sets may have at least one tuft disposed at an acute angle with respect to the longitudinal axis and at least one tuft disposed at an obtuse angle with respect to the longitudinal axis. The tuft patterns may be generally helical-shaped rows. The tuft patterns may be equally spaced with respect to each other around the circumference of the spindle.

The tufts may be disposed at acute angle ranges from 70° to 90° and obtuse angle ranges from 90° to 110° with respect to the spindle longitudinal axis. The acute angle and the obtuse angle may be supplementary angles.

In yet another embodiment, a brushroll assembly for use in a vacuum cleaner comprises a generally cylindrical shaped spindle substantially circular in cross-section throughout its entire length. The spindle comprises a first end, a second end, and a longitudinal axis.

A plurality of tufts are arranged in two generally helical-shaped rows. Each of the rows extends along the longitudinal axis between the first end and the second end. The tufts comprise a plurality of tuft pairs. Each pair includes one tuft from each of the tuft rows. Each tuft in the pair is equidistant from the first end. The tufts in each pair are diametrically opposed with respect to the spindle.

A majority of tuft pairs comprise one tuft disposed at an acute angle with respect to the longitudinal axis and one tuft disposed at an obtuse angle with respect to the longitudinal axis. The acute angles range from 70° to 90° and the obtuse angles range from 90° to 110° with respect to the longitudinal axis.

Other objects and advantages and a fuller understanding of the invention will become apparent to those skilled in the art from the following detailed description of the preferred embodiments and the accompanying drawings.

BRIEF DESCRIPTION OF THE DRAWINGS

FIG. 6 is a graph of experimental data measured during testing of prototype examples assembled in accordance with the present invention.

DESCRIPTION OF THE PREFERRED EMBODIMENTS

Figure 1:
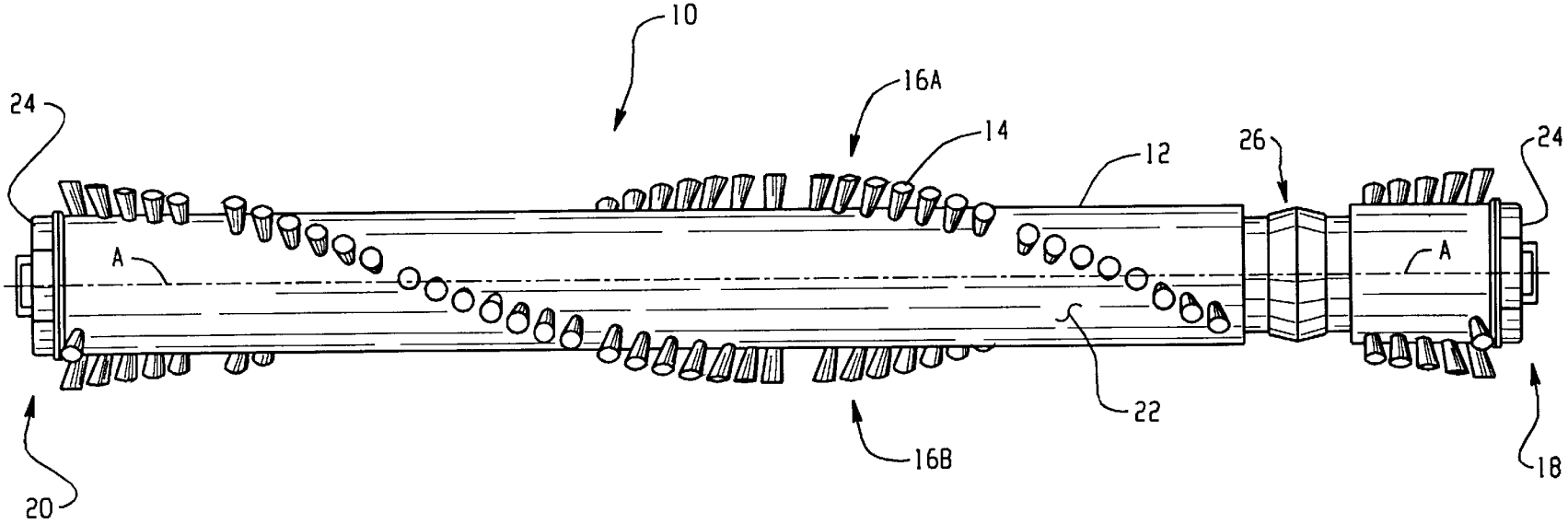
FIG. 1 is a side elevation view showing a brushroll of one embodiment of the present invention.

A brushroll 10 according to the present invention is shown in FIG. 1. As shown in FIG. 1, the brushroll 10 comprises a spindle 12, and a plurality of tufts 14. The tufts are formed in patterns of rotationally opposed tufts. The patterns are typically rows. In FIG. 1, two helical-shaped rows of rotationally opposed tufts are shown. The tufts also form a plurality of tuft pairs 16A, 16B. In one embodiment shown in FIG. 1, the spindle 12 is generally cylindrical shaped comprising a first end 18, a second end 20, and a longitudinal axis A, and an outer peripheral surface 22. The spindle is wooden and rotatably supported at each end by bearing assemblies 24. Each bearing assembly 24 is mounted on a vacuum cleaner nozzle (not shown) to position the brushroll 10. The spindle further comprises a belt drive surface 26 near the first end 18 shaped to accept a drive belt (not shown).

Each tuft 14 is formed by a plurality of nylon bristles. Other materials may be used such as propylene or the like. Typically, the bristles are cut from nylon filaments ranging from 0.008' to 0.014" in diameter. To form the tuft, small diameter holes are drilled into the wooden spindle 12 using methods known in the art. Holes known in the art typically range from 0.210 to 0.248 inches in depth. The individual bristles are suitably grouped and inserted into the performed holes. Various tuft patterns, including helical, double row, and straight patterns are known in the art. The individual bristles are typically of equal length.

As shown in FIG. 1, the majority of tufts in one row are disposed at acute angles with respect to the spindle axis and tilted toward one end of the spindle. A majority of tufts in the other row are disposed at obtuse angles with respect to the spindle axis and tilted toward the other end of the spindle. The specific angles of the tufts will be discussed later in more detail.

Figure 2:
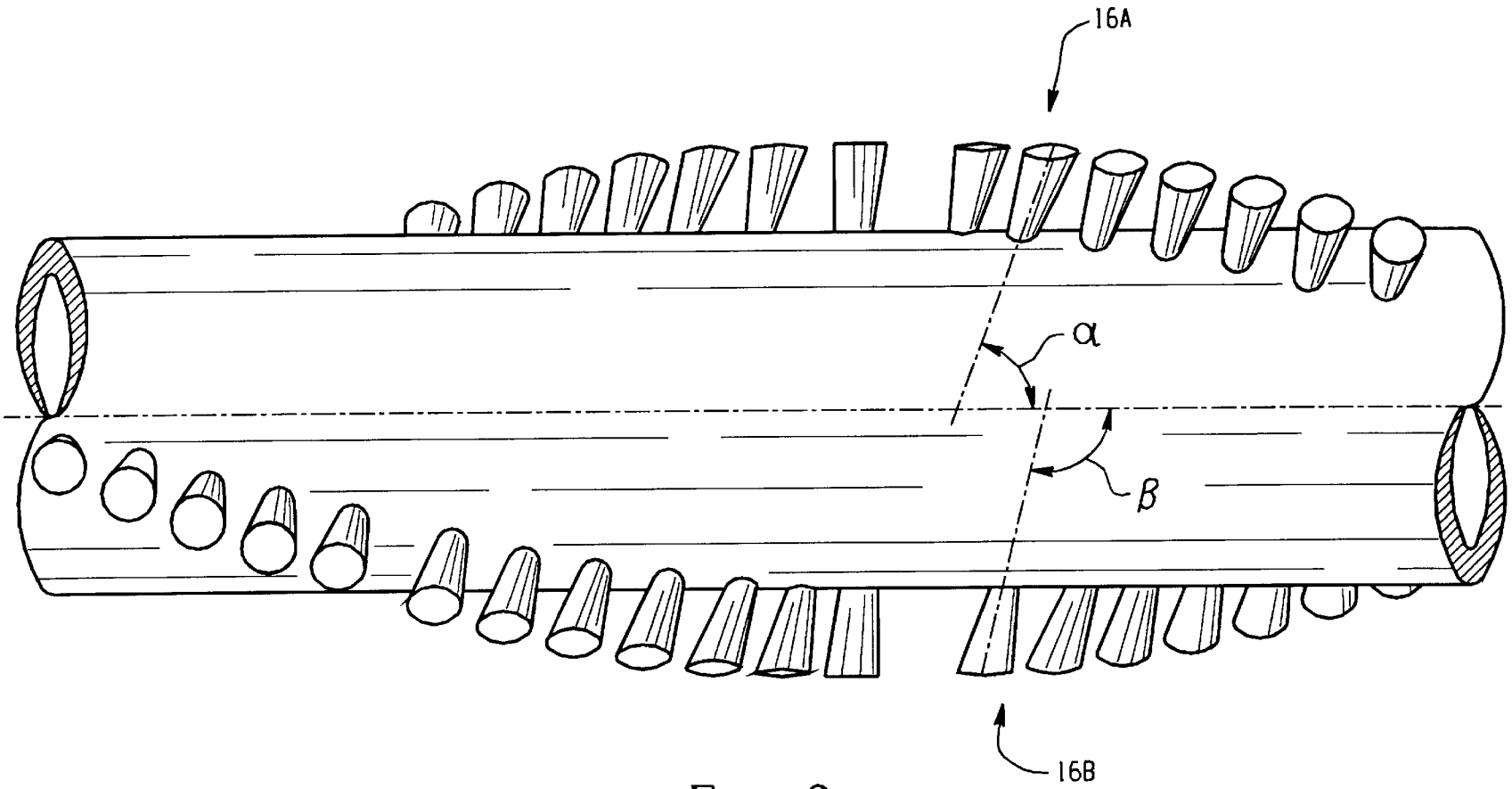
FIG. 2 is an enlarged elevation view of the midsection of the brushroll of FIG. 1 detailing the angled tuft pattern.

The tufts in one row are diametrically opposed to tufts in the other row. In this manner, the tufts form a plurality of tuft sets in the outer peripheral surface 22. In FIGS. 1 and 2, the tufts in one set are designated by reference characters 16A, 16B. Each set includes one tuft from each of the two tuft patterns, and each tuft 16A, 16B in the set is equidistant from the first end 18. The tufts in each set have a common sweeping path during the rotation of the spindle.

In a majority of the tuft sets, one tuft in a set is disposed at an acute angle with respect to the longitudinal axis A and a second tuft in a group is disposed at an obtuse angle with respect to the longitudinal axis A, and tilts from the perpendicular toward the right end of the spindle as viewed in FIG. 2. As shown in FIG. 2, one tuft 16A extends from the outer peripheral surface 22 at an acute angle $\alpha$ with respect to the longitudinal axis A and tilts from the perpendicular toward the right end of the spindle as viewed in FIG. 2. A second tuft 16B extends from the outer peripheral surface 22 at an obtuse angle $\beta$ with respect to the longitudinal axis A and tilts from the perpendicular toward the left end of the spindle. The acute angle α in FIG. 2 may range from 70° to 90°, and the obtuse angle β may range from 90° to 110°, whereby the tufts 16A and 16B tilt from a perpendicular to the spindle axis toward opposite ends of the spindle at an angle of from 0° to 20°. In a specific and preferred embodiment of the invention hereinafter described in connection with FIG. 4, the tilt angle ranges from 0° to 7°, whereby the acute angle α is in a range of from 83° to 90° and the obtuse angle β is in a range of from 90° to 97°. As shown in FIG. 2, the acute angle α and obtuse angle β may form supplementary angles, that is to say, the sum of the acute angle α and obtuse angle β equals 180°.

Figure 3:
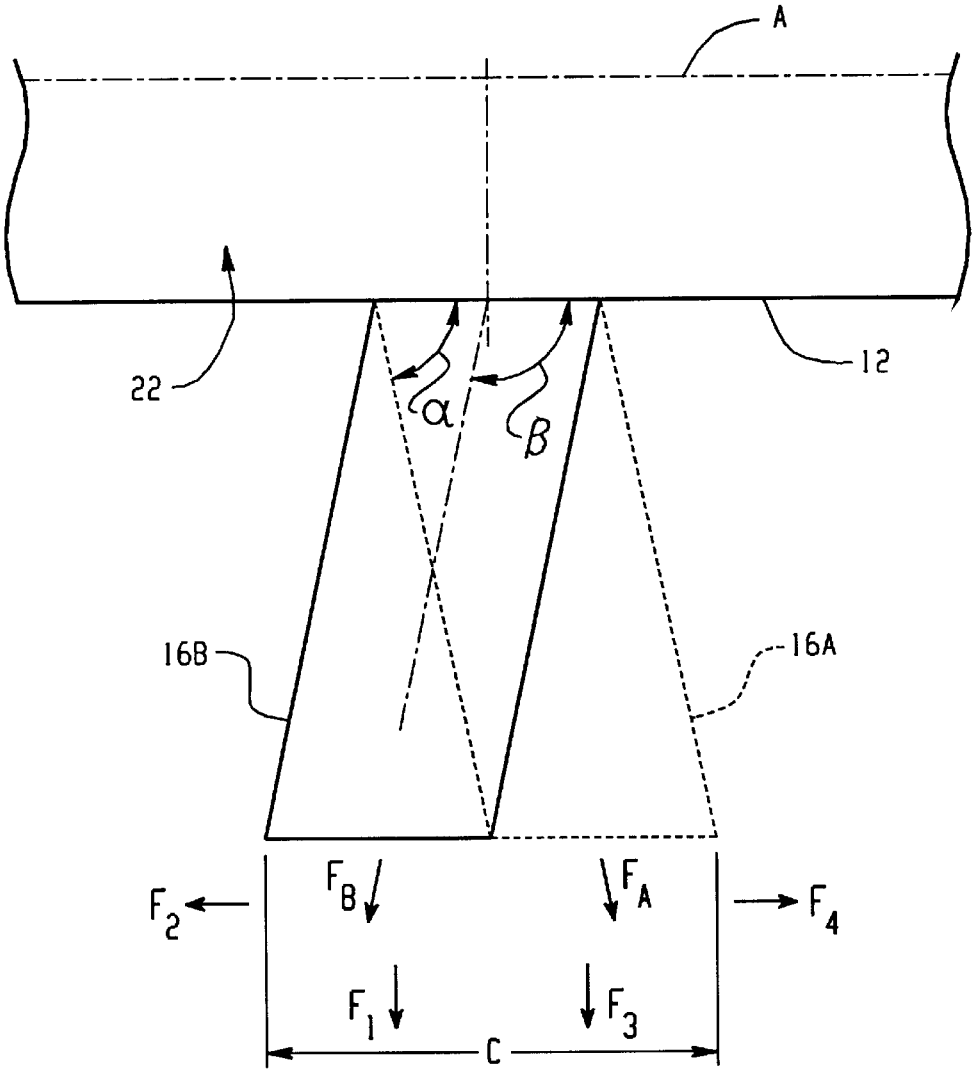
FIG. 3 is an enlarged view of one tuft set of the brushroll of FIG. 1.

FIG. 3 shows an enlarged view of a first tuft 16B and a second tuft 16A of the embodiment shown in FIGS. 1 and 2. The second tuft 16A is shown as a dashed-line figure to represent its location after the spindle has rotated 180° from the position in which the first tuft 16B is shown. The fist tuft 16B extends from the outer peripheral surface 22 of the spindle 12 at an obtuse angle β to the longitudinal axis A of the spindle 12. As the spindle rotates during operation of the vacuum sweeper, the first tuft 16B contacts fibers of the carpet. The contact results in a force $F_B$ applied to the fibers. This force $F_B$ may be represented by two component forces, a force $F_1$ parallel the direction of the vacuum, and a second force $F_2$ perpendicular to the first force $F_1$, as shown in FIG. 3. The resulting component forces act to move carpet fiber in generally two directions.

As the spindle rotates at speeds in excess of 5,000 rpm, in a single cycle of rotation, the second tuft 16A contacts the same carpet fibers as the first tuft 16B. The second tuft 16A extends from the outer peripheral surface 22 of the spindle 12 at an acute angle α to the longitudinal axis A of the spindle 12. The contact of the second tuft 16A results in a force $F_A$ applied to the fibers. This force $F_A$ may be represented by two component forces, a force $F_3$ parallel the direction of the vacuum, and a second force $F_4$ perpendicular to the first force $F_3$, as shown in FIG. 3. The resulting component forces act to move carpet fiber in generally two directions. The second force $F_4$ acts to move the carpet fibers contacted in the opposite direction as the perpendicular force $F_2$ supplied by $F_B$. This results in the carpet fibers within the combined coverage area of the first tuft 16B and the second tuft 16A being agitated in three directions.

The combined effective coverage zone C of the first tuft 16B and the second tuft 16A is shown in FIG. 3. This increase agitation results in increased performance for the vacuum cleaner, as measured by ASTM testing procedures, with all other parameters of the vacuum kept constant.

Figure 4:
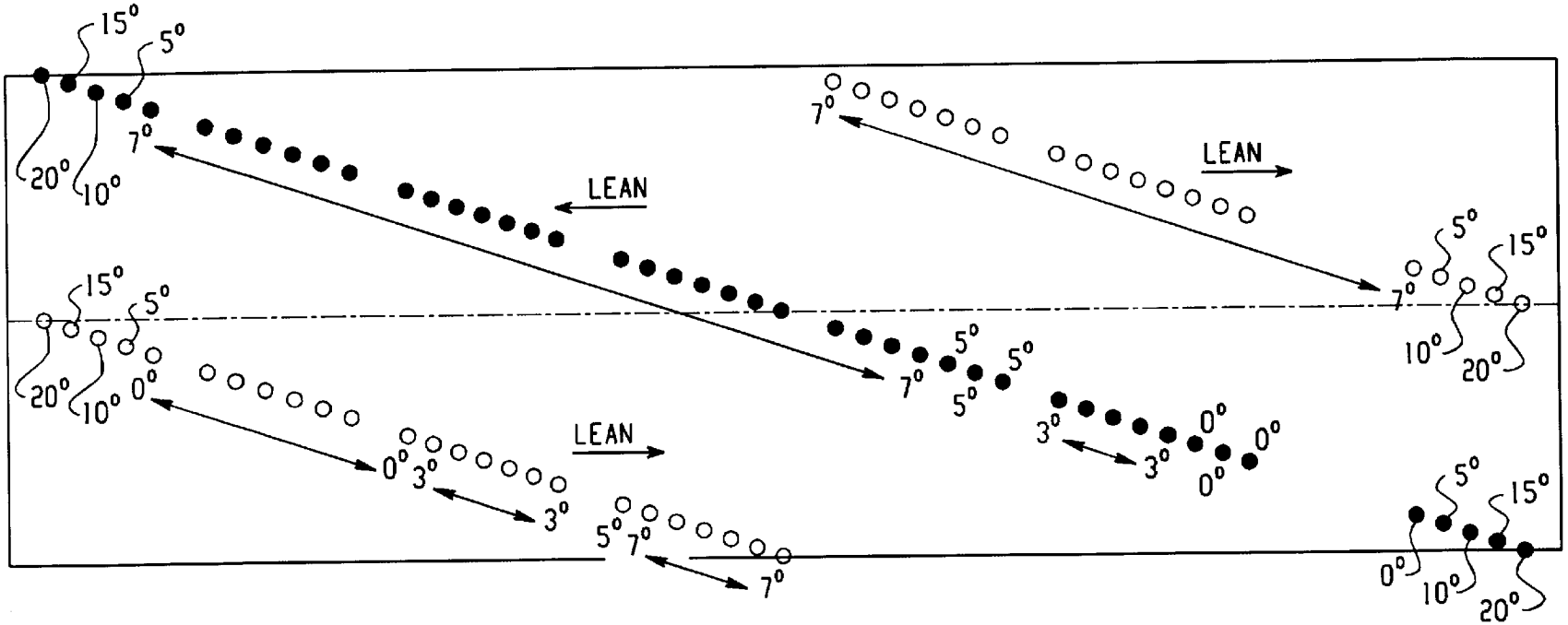
FIG. 4 is a schematic view of the brushroll of the embodiment shown in FIG. 1 as it would appear in an unrolled form.

Referring to FIG. 4, a schematic view of a brushroll of one embodiment of the present invention is shown as it would appear in an unrolled form. Two helical rows of bristles are represented by circles grouped in linear patterns. One row is represented as solid black circles, while a second row is represented as outlined or hollow circles.

The "solid black" row consists of forty-five tufts arranged in a helical pattern along the length of the spindle to complete one 360° rotation around its circumference. Four of these tufts at the right end of the spindle are positioned in a conventional manner at angles of 20°, 15°, 10° and 5°, proceeding from right to left. Four tufts at the left end of the spindle also are oriented in a conventional manner at angles of from 5°, 10°, 15° and 20°, proceeding from right to left. These conventionally oriented tufts at each end of the spindle "reach out" to carpet areas near the edge of the vacuum sweeper housing to increase the effective coverage area of the sweeper. These angled tufts also tend to prevent threads and other materials from embedding in the bearing end cap.

In accordance with the preferred embodiment of the invention illustrated in FIG. 4 and detailed in Table 2, thirty-seven of the forty-five "solid black" row of tufts are oriented in the following manner. Proceeding from right to left along the spindle axis, a first group of four tufts is perpendicular to the spindle axis. A second group of 5 tufts are angled from the perpendicular toward the left end of the spindle at 3°. Next, a third group of 3 tufts are angled from the perpendicular at 5°, also toward the left end of the spindle. Following these tufts, a fourth group of 25 sequential tufts are angled from the perpendicular toward the left end of the spindle at 7°. As shown in FIG. 4, the tufts in each group are tilted at increasingly larger angles progressively toward the left end of the spindle.

Also shown in FIG. 4 is a "hollow" row of 45 tufts which, like the "solid black" row, extend in a helical pattern along the length of the spindle and complete one 360° rotation about its axis. The "hollow" row of tufts includes four conventional end tufts at each end of the spindle. Proceeding from left to right, the tufts at the left end of the spindle are angled at 20°, 15°, 10° and 5°, and the tufts at the fight are oriented at angles of 5°, 10°, 15° and 20°. Again, tufts of this design are known in the prior art.

The thirty-seven remaining tufts in the "hollow" row are oriented according to the invention in the following manner. Proceeding from left to right, a first group of tufts comprise 8 tufts perpendicular to the spindle axis. Following sequentially, a second group of 6 tufts are angled from the perpendicular toward the right end of the spindle at 3°. Next, a third group of 1 tuft is angled from the perpendicular at 5°, also toward the right end of the spindle. Following the third group, a fourth group of 22 sequential tufts are angled from the perpendicular toward the right end of the spindle at 7°. As shown in FIG. 4, the tufts in each group are tilted at increasingly larger angles progressing toward the right end of the spindle.

In the embodiment shown in FIG. 4, the fourth group of tufts in the "solid black" row are rotationally opposed to tufts in the first, second, third and part of the fourth group of the "hollow" row of tufts. Likewise, the fourth group of tufts in the "hollow" row are rotationally opposed to tufts in the first, second, third and part of the fourth group of the "solid black" row of tufts.

Tufts in the "solid black" row form tuft pairs with rotationally opposed tufts in the "hollow" row that share common sweeping paths. Tufts in each pair are equidistant from one end of the spindle. Some of tuft pairs are comprised of tufts wherein one tuft is angled at an acute angle with respect to the spindle axis and one tuft is angled at an obtuse angle. In some pairs, the acute angle and the obtuse angle are supplemental angles.

The relation between the individual tufts in each tuft pair of the embodiment shown in FIG. 4 is detailed in Table 1. As previously described, the "solid black" and "hollow" rows make up 45 tuft pairs in total. Of the 45 tuft pairs, there are 8 pairs of conventional tufts at the ends of the spindle. Of the remaining thirty-seven tuft pairs, which are angled according to this invention, there are 10 pairs of tufts tilted at supplemental angles with respect to the longitudinal axis of the spindle, and there are 14 pairs tilted at angles of 5° and 7° from the perpendicular. The 14 tuft pairs tilted at angles of 5° and 7° from the perpendicular are made up of the three tufts in the third group of "solid black" row tufts which are paired with three of the 7° angled tufts in the fourth group of "hollow" row tufts, ten tufts in the fourth group of the "solid black" row which are paired with ten tufts in the fourth row of "hollow" row tufts, and one tuft in the third group of the "hollow" row which is paired with a tuft of the fourth group of "solid black" row tufts.

As has been previously described in connection with FIG. 3, the rotationally opposed, paired tufts of the two helical rows result in increased performance of a vacuum cleaner as measured by ASTM Testing Procedures. It has been found that excellent results are obtained when at least thirty percent of the paired tufts tilt at either side of the perpendicular at angles of from 5° to 7°, as detailed in Table 1, which is to say that the acute angle $\alpha$ varies from 83° to 87° and the obtuse angle $\beta$ varies from 93° to 97°.

TABLE 1

Relation of Tuft Pairs of embodiment shown in FIG. 4

| Left to Right | "Solid Black" Row | | | "Hollow" Row | | | |
|---|---|---|---|---|---|---|---|
| Tuft Pair # | Group | Angle | Direction | Group | Angle | Direction | Pair Relation |
| 1 | | 20 | Left | | 20 | Left | Conventional |
| 2 | | 15 | Left | | 15 | Left | Conventional |
| 3 | | 10 | Left | | 10 | Left | Conventional |
| 4 | | 5 | Left | | 5 | Left | Conventional |
| 5 | Fourth | 7 | Left | First | 0 | Perpendicular | |
| 6 | Fourth | 7 | Left | First | 0 | Perpendicular | |
| 7 | Fourth | 7 | Left | First | 0 | Perpendicular | |
| 8 | Fourth | 7 | Left | First | 0 | Perpendicular | |
| 9 | Fourth | 7 | Left | First | 0 | Perpendicular | |
| 10 | Fourth | 7 | Left | First | 0 | Perpendicular | |
| 11 | Fourth | 7 | Left | First | 0 | Perpendicular | |
| 12 | Fourth | 7 | Left | First | 0 | Perpendicular | |
| 13 | Fourth | 7 | Left | Second | 3 | Right | |
| 14 | Fourth | 7 | Left | Second | 3 | Right | |
| 15 | Fourth | 7 | Left | Second | 3 | Right | |
| 16 | Fourth | 7 | Left | Second | 3 | Right | |
| 17 | Fourth | 7 | Left | Second | 3 | Right | |
| 18 | Fourth | 7 | Left | Second | 3 | Right | |
| 19 | Fourth | 7 | Left | Third | 5 | Right | |
| 20 | Fourth | 7 | Left | Fourth | 7 | Right | Supplemental |
| 21 | Fourth | 7 | Left | Fourth | 7 | Right | Supplemental |
| 22 | Fourth | 7 | Left | Fourth | 7 | Right | Supplemental |
| 23 | Fourth | 7 | Left | Fourth | 7 | Right | Supplemental |
| 24 | Fourth | 7 | Left | Fourth | 7 | Right | Supplemental |
| 25 | Fourth | 7 | Left | Fourth | 7 | Right | Supplemental |
| 26 | Fourth | 7 | Left | Fourth | 7 | Right | Supplemental |
| 27 | Fourth | 7 | Left | Fourth | 7 | Right | Supplemental |
| 28 | Fourth | 7 | Left | Fourth | 7 | Right | Supplemental |
| 29 | Fourth | 7 | Left | Fourth | 7 | Right | Supplemental |
| 30 | Third | 5 | Left | Fourth | 7 | Right | |
| 31 | Third | 5 | Left | Fourth | 7 | Right | |
| 32 | Third | 5 | Left | Fourth | 7 | Right | |
| 33 | Second | 3 | Left | Fourth | 7 | Right | |
| 34 | Second | 3 | Left | Fourth | 7 | Right | |
| 35 | Second | 3 | Left | Fourth | 7 | Right | |
| 36 | Second | 3 | Left | Fourth | 7 | Right | |
| 37 | Second | 3 | Left | Fourth | 7 | Right | |
| 38 | First | 0 | Perpendicular | Fourth | 7 | Right | |
| 39 | First | 0 | Perpendicular | Fourth | 7 | Right | |
| 40 | First | 0 | Perpendicular | Fourth | 7 | Right | |
| 41 | First | 0 | Perpendicular | Fourth | 7 | Right | |
| 42 | | 5 | Right | | 5 | Right | Conventional |
| 43 | | 10 | Right | | 10 | Right | Conventional |
| 44 | | 15 | Right | | 15 | Right | Conventional |
| 45 | | 20 | Right | | 20 | Right | Conventional |

Figure 5:
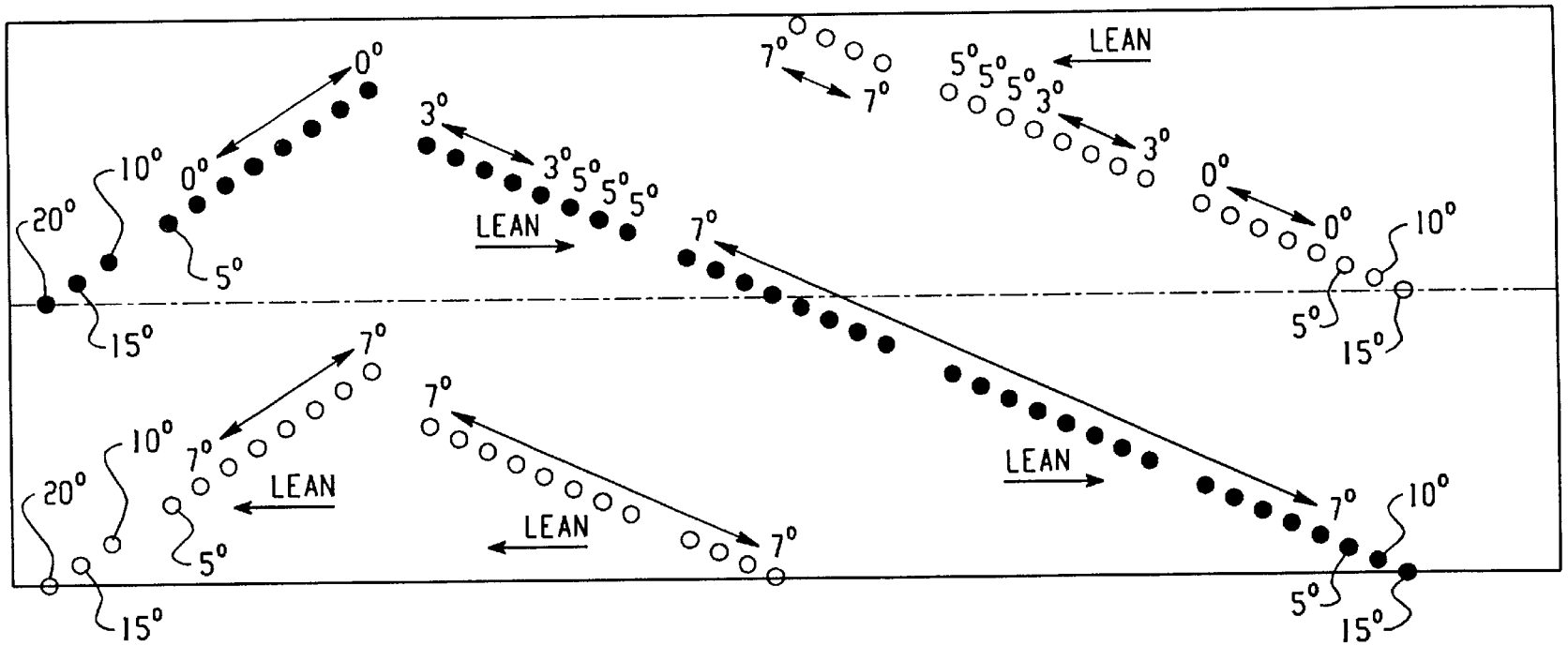
FIG. 5 is a schematic view of a brushroll of another embodiment of the present invention as it would appear in an unrolled form.

Referring now to FIG. 5, a schematic view of a brushroll of another embodiment of the present invention is shown as it would appear in an unrolled form. Two helical rows of bristles are represented by circles grouped in linear patterns. One row is represented as solid black circles, while a second row is represented as outlined hollow circles.

The "solid black" row includes 43 tufts. The first four tufts at the left end of the spindle are conventional and are angled toward the left end of the spindle at 20°, 15°, 10°, and 5° proceeding from left to right. A group of three tufts at the right end of the row are angled at 5°, 10° and 15°, proceeding from left to right. Tufts of this design are known in the prior art. Angled tufts near either end of the spindle "reach out" to carpet areas near the edge of the vacuum sweeper housing to increase the effective coverage area of the sweeper. These angled tufts also tend to prevent threads and other materials from embedding in the bearing end cap.

Still proceeding from left to right a first group of 7 tufts are perpendicular to the spindle axis. Following sequentially, a second group of 5 tufts are angled to right end of the spindle at 3° with respect to the perpendicular to the spindle axis. Next, a third group of 3 tufts are angled at 5°, also toward the right end of the spindle. Following these tufts, a fourth group comprises 21 sequential tufts angled to the right end of the spindle at 7°.

As shown in FIG. 5, the helical pattern of the "solid black" row travels the length of the spindle. The helix pattern is interrupted in its rotation around the spindle. Defined by travel left to right, the helix pattern completes a 135° rotation around the circumference of the spindle. The pattern then rotates in the opposite rotational direction 290° around the circumference of the spindle.

Also shown in FIG. 5 is a "hollow" row of tufts. The "hollow" row includes 43 tufts. The first three tufts at the right end of the row are conventional and are angled toward the right end of the spindle at 5°, 10°, and 15°, right to left. At the left end of the row are four conventional tufts angled at 5°, 10°, 15° and 20°, proceeding from right to left. These end tufts are conventional.

Still proceeding from right to left, a first group of tufts comprises 5 tufts perpendicular to the spindle axis. Following sequentially, a second group of 5 tufts is angled to left end of the spindle at 3°, with respect to the perpendicular to the spindle axis. Next, a third group of 3 tufts are angled at 5°, also toward the left end of the spindle. Following these tufts, a group of 23 sequential tufts are angled to the left end of the spindle at 7°.

As shown in FIG. 5, the helical pattern of the hollow row tufts travels the length of the spindle. The helix pattern is interrupted in its rotation around the spindle. Defined by travel right to left, the helix pattern completes a 290° rotation around the circumference of the spindle. The pattern then rotates in the opposite direction 135° around the circumference of the spindle.

In the embodiment shown in FIG. 5, the fourth group of tufts in the "solid black" row are rotationally opposed to tufts in the first, second, third and part of the fourth group of the "hollow" row of tufts. Likewise, the fourth group of tufts in the "hollow" row are rotationally opposed to tufts in the first, third and part of the fourth group of the "solid black" row of tufts.

Tufts in the "solid black" row form tuft pairs with tufts in the "hollow" row that share common sweeping paths. Tufts in each pair are equidistant from one end of the spindle. Some of tuft pairs are comprised of tufts wherein one tuft is angled at an acute angle with respect to the spindle axis and one tuft is angled at an obtuse angle. In some pairs, the acute angle and the obtuse angle are supplemental angles.

The relation between the individual tufts in each tuft pair of the embodiment shown in FIG. 5 is detailed in Table 2 that follows. There are 43 tuft pairs in total. Of the remaining 36 tuft pairs, there are 7 pairs of conventional tufts at the ends of the spindle. Of the remaining 43 tuft pairs, there are 7 pairs of tufts tilted at supplemental angles with respect to the longitudinal axis of the spindle, and there are fourteen tuft pairs tilted at angles of 5° and 7° from the perpendicular. The 14 tuft pairs tilted at 5° and 7° are made up of the third group of the "solid black" rows which are paired with three of the 7° angled tufts of the fourth group of the "hollow" row, eight tufts of the fourth group in the "solid black" row which are paired with eight tufts of the fourth group of the "hollow" row, and the third group of the "hollow" row which is paired with three tufts in the fourth group of the "solid black" row.

As been previously described in connection with the embodiment of the invention detailed in Table 1, at least 30 percent of the paired tufts making up the "solid black" row and "hollow" row tilt at either side of the perpendicular at angles of from 5° to 7°, as detailed in Table 2.

TABLE 2

Relation of Tuft Pairs of embodiment shown in FIG. 5

| Left to Right | "Solid Black" Row | | | "Hollow" Row | | | |
|---|---|---|---|---|---|---|---|
| Tuft Pair # | Group | Angle | Direction | Group | Angle | Direction | Pair Relation |
| 1 | | 20 | Left | | 20 | Left | Conventional |
| 2 | | 15 | Left | | 15 | Left | Conventional |
| 3 | | 10 | Left | | 10 | Left | Conventional |
| 4 | | 5 | Left | | 5 | Left | Conventional |
| 5 | First | 0 | Perpendicular | Fourth | 7 | Left | |
| 6 | First | 0 | Perpendicular | Fourth | 7 | Left | |
| 7 | First | 0 | Perpendicular | Fourth | 7 | Left | |
| 8 | First | 0 | Perpendicular | Fourth | 7 | Left | |
| 9 | First | 0 | Perpendicular | Fourth | 7 | Left | |
| 10 | First | 0 | Perpendicular | Fourth | 7 | Left | |
| 11 | First | 0 | Perpendicular | Fourth | 7 | Left | |
| 12 | Second | 3 | Right | Fourth | 7 | Left | |
| 13 | Second | 3 | Right | Fourth | 7 | Left | |
| 14 | Second | 3 | Right | Fourth | 7 | Left | |
| 15 | Second | 3 | Right | Fourth | 7 | Left | |
| 16 | Second | 3 | Right | Fourth | 7 | Left | |
| 17 | Third | 5 | Right | Fourth | 7 | Left | |
| 18 | Third | 5 | Right | Fourth | 7 | Left | |
| 19 | Third | 5 | Right | Fourth | 7 | Left | |
| 20 | Fourth | 7 | Right | Fourth | 7 | Left | Supplemental |
| 21 | Fourth | 7 | Right | Fourth | 7 | Left | Supplemental |
| 22 | Fourth | 7 | Right | Fourth | 7 | Left | Supplemental |
| 23 | Fourth | 7 | Right | Fourth | 7 | Left | Supplemental |
| 24 | Fourth | 7 | Right | Fourth | 7 | Left | Supplemental |
| 25 | Fourth | 7 | Right | Fourth | 7 | Left | Supplemental |
| 26 | Fourth | 7 | Right | Fourth | 7 | Left | Supplemental |
| 27 | Fourth | 7 | Right | Fourth | 7 | Left | |
| 28 | Fourth | 7 | Right | Third | 5 | Left | |
| 29 | Fourth | 7 | Right | Third | 5 | Left | |
| 30 | Fourth | 7 | Right | Third | 5 | Left | |
| 31 | Fourth | 7 | Right | Second | 3 | Left | |
| 32 | Fourth | 7 | Right | Second | 3 | Left | |

TABLE 2-continued

| Relation of Tuft Pairs of embodiment shown in FIG. 5 | | | | | | | |
|---|---|---|---|---|---|---|---|
| Left to Right | "Solid Black" Row | | | "Hollow" Row | | | |
| Tuft Pair # | Group | Angle | Direction | Group | Angle | Direction | Pair Relation |
| 33 | Fourth | 7 | Right | Second | 3 | Left | |
| 34 | Fourth | 7 | Right | Second | 3 | Left | |
| 35 | Fourth | 7 | Right | Second | 3 | Left | |
| 36 | Fourth | 7 | Right | First | 0 | Perpendicular | |
| 37 | Fourth | 7 | Right | First | 0 | Perpendicular | |
| 38 | Fourth | 7 | Right | First | 0 | Perpendicular | |
| 39 | Fourth | 7 | Right | First | 0 | Perpendicular | |
| 40 | Fourth | 7 | Right | First | 0 | Perpendicular | |
| 41 | | 5 | Right | | 5 | Right | Conventional |
| 42 | | 10 | Right | | 10 | Right | Conventional |
| 43 | | 15 | Right | | 15 | Right | Conventional |

EXPERIMENTAL DATA

Experimental results of the present invention are shown in summarized form in FIG. 6. It is well accepted by those skilled in the art that the performance of a vacuum cleaner can be measured by the ASTM procedure F608-89, *Standard Laboratory Test Method for Evaluation of Carpet-Embedded Dirt Removal Effectiveness of Household Vacuum Cleaners.* The procedure must be conducted in an environmentally controlled room, under specific conditions. Only approved carpet samples may be used. The samples are soiled using a specified sand and talc mixture. The mixture is embedded into the carpet fibers by a dirt embedment tool of designated shape and weight. The tool is dragged across the sample in a repeatable pattern. The experiments summarized in FIG. 6 were performed on an approved plush carpet sample. The experiments consistently achieved repeatable results.

Six commercially available sweepers were selected as test samples for the experiments. The sweepers were manufactured by two different original equipment manufacturers. Each vacuum was tested without modification, and the results appear in the column labeled "OEM Stock Performance" in FIG. 6. The percentage figure shown is the percent of dirt removed within a designated time cleaning period. Each stock spindle was then removed from the vacuum and replaced with a spindle manufactured in accordance with an embodiment of the present invention, as shown in FIGS. 1 and 2. No other modifications were made to the sweepers. The sweepers, as modified with the improved brushroll of the present invention, consistently and repeatedly out performed the sweepers in stock condition.

The cleanability performance of the sweepers using the modified brushroll appear results in the column labeled "Modification with Angled Bristles" in FIG. 6. The column labeled "Percentage Improvement" in FIG. 6 details the increased cleanability of each sweeper tested, as a percentage of the cleanability in original stock condition. All test sample sweepers showed improved performance when using the improved brushroll of the present invention. A majority of the test sample sweepers exhibited cleanability increases of over 10%. It can be seen from the results, that without changing vacuum characteristics, decreasing maneuverability, or accelerating belt wear, the improved brushroll of the present invention increases the cleanability performance of a vacuum sweeper.

Many variations and modifications of the invention will be apparent to those skilled in the art from the above detailed description. Therefore, it is to be understood that, within the scope of the appended claims, the invention can be practiced otherwise than as specifically shown and described.

What is claimed is:

1. A brushroll for use in a vacuum cleaner comprising:

a) a spindle having first and second ends and a longitudinal axis;

b) first and second rows of rotationally opposed bristle tufts;

c) said first row having a majority of its tufts disposed at acute angles with respect to the spindle axis and tilted toward said first end of said spindle;

d) said second row having a majority of its tufts disposed at obtuse angles with respect to the spindle axis and tilted toward said second end of said spindle; and e) wherein a majority of the tilted tufts of said first row are at an obtuse angle of 97°, and at least some of the tilted tufts of said second row are at supplemental angles of 83°.

2. The brushroll of claim 1 wherein tilted tufts of said fist row are paired with tilted tufts of said second row with the tufts in each pair being equidistant from an end of said spindle, wherein tufts of each pair have a common sweeping path.

3. The brushroll of claim 1 or 2 wherein said first and second rows are diametrically opposed with respect to said spindle.

4. A vacuum cleaner brushroll comprising:

a) a spindle having first and second ends and a longitudinal axis;

b) first and second rows of bristle tufts extending along helical paths;

c) said first row, beginning near said first end of said spindle and continuing toward said second end, having a group of tufts perpendicular to the spindle axis, a second group of tufts tilted toward said second end at an angle of 3° from the perpendicular to the spindle axis, a third group of tufts tilted toward said second end at an angle of 5° from the perpendicular to the spindle axis, and a fourth group of tufts tilted toward said second end at an angle of 7° from the perpendicular to the spindle axis;

d) said second row, beginning near said second end and continuing toward said first end, having a first group of tufts perpendicular to the spindle axis, a second group of tufts tilted toward said first end at an angle of 3° from the perpendicular to the spindle axis, a third group of tufts tilted toward said end at an angle of 5° from the perpendicular to the spindle axis, and a fourth group of tufts tilted toward said end at an angle of 7° from the perpendicular to the spindle axis;

e) said fourth row of tufts of said first row being rotationally opposed to said first, second, third and part of the fourth group of tufts of said second row; and f) said fourth group of tufts of said second row being rotationally opposed to the first, second, third and part of said fourth groups of tufts of said first row.

5. A brushroll as claimed in claim 4 wherein said first and second rows of tufts are diametrically opposed.

6. A vacuum cleaner brushroll comprising:

a) a spindle having first and second ends and a longitudinal axis;

b) first and second rows of rotationally opposed bristle tufts;

c) said first row having a majority of its tufts arranged in tuft groups each having multiple tufts tilted toward said first end of said spindle with the tufts in each group being tilted at the same angle with respect to the perpendicular to the axis of said spindle and at a different angle than the tufts in the other groups of said first row; and d) said second row having a majority of its tufts arranged in tuft groups that are tilted toward said second end of said spindle with the tufts in each group being tilted at the same angle with respect to the perpendicular to the axis of said spindle and at a different angle than the tufts in the other groups of said second row.

7. The brushroll as claimed in claim 6 wherein each row includes at least one group of tufts adjacent an end of said spindle that are perpendicular to the axis of said spindle.

8. A brushroll as claimed in claim 6 or 7 wherein the tuft groups in said first row are tilted at increasingly larger angles progressing toward said first end of said spindle, and the tuft groups in said second row are tilted at increasingly larger angles progressing toward said second end of said spindle.

9. The brushroll as claimed in claim 8 wherein said first and second rows of tufts are diametrically opposed with respect to said spindle.

10. A brushroll assembly for use in a vacuum cleaner comprising:

a) a generally cylindrical shaped spindle having a first end, a second end and a longitudinal axis;

b) a plurality of tufts arranged in at least two tuft patterns, wherein each of said tuft patterns extends along said longitudinal axis;

c) said tuft patterns defining a plurality of tuft sets, each said tuft set including one tuft from each of said at least two tuft portions, and wherein each tuft in said set is equidistant from said first end; and d) wherein a majority of tuft sets have at least one tuft set disposed at an acute angle with respect to said longitudinal axis and at least one tuft disposed at an obtuse angle with respect to said longitudinal axis.

11. The brushroll of claim 10 wherein each said tuft pattern is a generally helical-shaped row.

12. The brushroll of claim 10 wherein said tuft patterns are equally spaced with respect to each other around the circumference of said spindle.

13. The brushroll of claim 10 wherein said acute angle ranges from 70° to 90° and said obtuse angle ranges from 90° to 110° with respect to the spindle longitudinal axis.

14. A brushroll assembly for use in a vacuum cleaner comprising:

a) a generally cylindrical shaped spindle substantially circular in cross-section throughout its entire length, comprising a first end, a second end, and a longitudinal axis;

b) a plurality of tufts arranged in two generally helically-shaped rows, wherein each of said rows extends along the longitudinal axis between said first end and said second end;

c) said tufts comprising a plurality of tuft pairs, each said pair including one tuft from each of said tuft rows, wherein each tuft in said pair is equidistant from said first end, and wherein the tufts in each said pair are diametrically opposed with respect to said spindle; and d) wherein a majority of tuft pairs comprise one tuft disposed at an acute angle with respect to said longitudinal axis and one tuft disposed at an obtuse angle with respect to said longitudinal axis, wherein said acute angle ranges from 70° to 90° and wherein said obtuse angle ranges from 90° to 110° with respect to said longitudinal axis.

15. A brushroll for use in a vacuum cleaner comprising:

a) a spindle having first and second ends and a longitudinal axis;

b) first and second rows of rotationally opposed bristle tufts;

c) said first row having a majority of its tufts disposed at acute angles with respect to said longitudinal axis and tilted toward said first end of said spindle;

d) said second row having a majority of its tufts disposed at obtuse angles with respect to said longitudinal axis and tilted toward said second end of said spindle; and e) wherein a majority of the tilted tufts of said first row are at an obtuse angle of 97°, and at least some of the tilted tufts of said second row are at supplemental angles of 83°; and wherein f) said tilted tufts of said first and second rows are diametrically opposed with respect to said spindle.

16. A brushroll assembly for use in a vacuum cleaner comprising:

a) a generally cylindrically shaped spindle having a first end, a second end and a longitudinal axis;

b) a plurality of tufts arranged in at least two tuft patterns, wherein each of said tuft patterns extends along said longitudinal axis;

c) said tuft patterns defining a plurality of tuft sets, each said tuft set including one tuft from each of said at least two tuft patterns, and wherein each tuft in said set is equidistant from said first end; and d) wherein at least one tuft set has at least one tuft disposed at an acute angle with respect to said longitudinal axis and at least one tuft disposed at an obtuse angle with respect to said longitudinal axis, said acute angle and said obtuse angle being supplementary angles.

17. A vacuum cleaner brushroll comprising:

a) a spindle having first and second ends and a longitudinal axis, b) first and second rows of bristle tufts, and c) said first row having a majority of its tufts tilted toward said first end at an angle of from 5° to 7° from the perpendicular to said longitudinal axis, and said second row having a majority of its tufts tilted toward said second end at an angle of from 5° to 7° from the perpendicular to said longitudinal axis.

18. A brushroll as claimed in claim 17 wherein said majority of tufts of said first row and said majority of tufts of said second row are arranged in groups with each tuft in a group being tilted at the same angle.

19. A vacuum cleaner brushroll comprising:

a) a spindle having first and second ends and a longitudinal axis, b) first and second rows of bristle tufts, c) said first row having a majority of its tufts tilted toward said first end at an angle of from 5° to 7° from the perpendicular to said longitudinal axis, said second row of tufts having a majority of its tufts tilted toward said second end at an angle of from 5° to 7° from the perpendicular to said longitudinal axis, and d) said tufts of said first row tilted at 5° to 7° being paired with tufts of said second row tilted at 5° to 7° with the tufts in each pair being equidistant from an end of said spindle so that the tufts of each pair have a common sweeping path.

20. A vacuum cleaner brushroll comprising:

a) a spindle having first and second ends and a longitudinal axis, b) first and second rows of rotationally opposed bristle tufts, c) said first row of bristle tufts being arranged in groups with one group being perpendicular to the spindle axis near said first end and the remaining groups are tilted from the perpendicular at increasingly larger angles proceeding toward said second end of said spindle, d) said second row of bristle tufts being arranged in groups with one group being perpendicular to the spindle axis near said second end and the remaining groups being tilted from the perpendicular at increasingly larger angles progressing towards said first end of said spindle, and e) a majority of said groups of said first row being paired with groups of said second row with the tufts in each pair being equidistant from an end of said spindle so that the paired groups have a common sweeping path.

21. A vacuum cleaner brushroll as claimed in claim 20 wherein said majority of said groups of said first row each include at least one tuft tilted at an acute angle with respect to said longitudinal axis, and wherein a majority of said groups of said second row have at least one tuft disposed at an obtuse angle with respect to said longitudinal axis.

22. A vacuum cleaner brushroll as claimed in claim 20 wherein at least 30 percent of said groups of said first row and 30 percent of said groups of said second row are made up of bristles which tilt from the perpendicular to said longitudinal axis at an angle of from 5° to 7°.

* * * * *

UNITED STATES PATENT AND TRADEMARK OFFICE

CERTIFICATE OF CORRECTION

PATENT NO. : 6,574,823 B1
DATED : June 10, 2003
INVENTOR(S) : Alfred H. Stegens

It is certified that error appears in the above-identified patent and that said Letters Patent is hereby corrected as shown below:

Column 7,
Line 11, "87º" should read -- 85º --.
Line 12, "93º" should read -- 95º --.

Column 12,
Line 35, change "first" to -- second --.
Line 37, change "second" to -- first --.

Column 14,
Line 33, change "first" to -- second --.
Line 35, change "second" to -- first --.

Signed and Sealed this

Fourteenth Day of October, 2003

JAMES E. ROGAN
*Director of the United States Patent and Trademark Office*